US011737949B1

(12) United States Patent
Huang et al.

(10) Patent No.: US 11,737,949 B1
(45) Date of Patent: Aug. 29, 2023

(54) PENIS MASSAGER

(71) Applicant: Junpeng Wu, Shenzhen (CN)

(72) Inventors: Tenghui Huang, Guangdong (CN); Junpeng Wu, Shenzhen (CN)

( * ) Notice: Subject to any disclaimer, the term of this patent is extended or adjusted under 35 U.S.C. 154(b) by 0 days.

(21) Appl. No.: 18/119,856

(22) Filed: Mar. 10, 2023

(30) Foreign Application Priority Data

Mar. 8, 2023 (CN) ..... 202320429670.X

(51) Int. Cl.
*A61H 19/00* (2006.01)

(52) U.S. Cl.
CPC ..... *A61H 19/32* (2013.01); *A61H 2201/1215* (2013.01); *A61H 2201/149* (2013.01); *A61H 2201/1654* (2013.01); *A61H 2201/1669* (2013.01); *A61H 2201/1692* (2013.01)

(58) Field of Classification Search
None
See application file for complete search history.

(56) References Cited

U.S. PATENT DOCUMENTS

2022/0168174 A1* 6/2022 Von Buttlar ..... A61H 15/0085

FOREIGN PATENT DOCUMENTS

CN 115177506 A * 10/2022

* cited by examiner

*Primary Examiner* — Thaddeus B Cox

(57) ABSTRACT

A penis massager includes a housing, a massager member and a driving apparatus. The massager member includes a first massaging portion and a second massaging portion which are separately arranged. A space for inserting of the penis is defined between the first massaging portion and the second massaging portion. The driving apparatus is in transmission connection with the first massaging portion and the second massaging portion respectively for driving the first massaging portion and the second massaging portion to reciprocate in an axial direction of the housing. A movement direction of the first massaging portion is opposite to that of the second massaging portion.

20 Claims, 15 Drawing Sheets

PENIS MASSAGER

CROSS-REFERENCE TO RELATED APPLICATIONS

This application claims priority to Chinese Patent Application No. 202320429670.X filed on Mar. 8, 2023, the entire contents of which are hereby incorporated by reference.

TECHNICAL FIELD

The present invention relates to the technical field of massage devices, more particularly relates to a penis massager.

BACKGROUND

Penis massagers are configured for simulating a vaginal environment and providing a massaging stimulation to the male genitalia. Generally, the penis massager includes a housing and a soft sleeve being movably mounted in a housing. During sexual intercourse, the sleeve generates a movement, such as an axial reciprocation relative to the penis to simulate a thrusting motion. However, the penis massagers in the related art are simple in structures and the stimulations to the penises are not sufficient, so that the user experience is poor.

SUMMARY

An object of an embodiment of the present invention is to provide a penis massager with good user experience.

In order to achieve the above-mentioned object, the present invention provides a penis massager, including:

a housing;

a massager member including a first massaging portion and a second massaging portion which are separately arranged, and a space for inserting of the penis being defined between the first massaging portion and the second massaging portion; and a driving apparatus arranged in the housing, the driving apparatus being in transmission connection with the first massaging portion and the second massaging portion respectively for driving the first massaging portion and the second massaging portion to reciprocate in an axial direction of the housing, a movement direction of the first massaging portion being opposite to that of the second massaging portion.

Compared with the prior art, the penis massager of the present invention has the following beneficial effects: enhancing the stimulation to the male genital and improving the user experience, which is realized in such a way that the massager member and the driving apparatus are arranged in the housing, and the driving apparatus drive the first massaging portion and the second massaging portion of the massager member to reciprocate in the axial direction to complete the rubbing action on the penis of the penis massager.

BRIEF DESCRIPTION OF THE DRAWINGS

In order to more clearly explain technical solutions in embodiments of the present invention, accompanying drawings required to be used in the embodiments or the description of the prior art will be briefly introduced below. Apparently, the accompanying drawings in the following description are only some embodiments of the present invention. For those ordinarily skilled in the art, other accompanying drawings may be obtained from these accompanying drawings without paying any creative labor.

DESCRIPTION OF THE EMBODIMENTS

In order to make technical problems, technical solutions and beneficial effects to be solved in the present invention clearer, the present invention will be further described below in detail in conjunction with accompanying drawings and embodiments. It should be understood that specific embodiments described herein are only used to explain the present invention and not to limit the present invention.

It should be noted that when an element is referred to as "fixed to" or "arranged on" another element, it may be directly or indirectly on another element. When an element is referred to as "connected to" another element, it may be directly or indirectly connected to another element.

It should be understood that the orientational or positional relationship indicated by terms "length", "width", "up", "down", "front", "back", "left", "right", "vertical", "horizontal", "top", "bottom", "inside", "outside", and the like is based on the orientational or positional relationship shown in the accompanying drawings, and is only for the sake of describing the present invention and simplifying the description instead of indicating or implying that the apparatus or element referred to must have a specific orientation, and must be constructed and operated in a specific orientation, so it cannot be understood as a limitation of the present invention.

Also, terms "first" and "second" are only used for describing purposes, and cannot be understood as indicating or implying relative importance or implying the number of technical features indicated. Therefore, features defined with "first" and "second" can explicitly or implicitly include one or more of these features. In the description of the present invention, "a plurality of" means two or more, unless otherwise specified.

Figure 1:
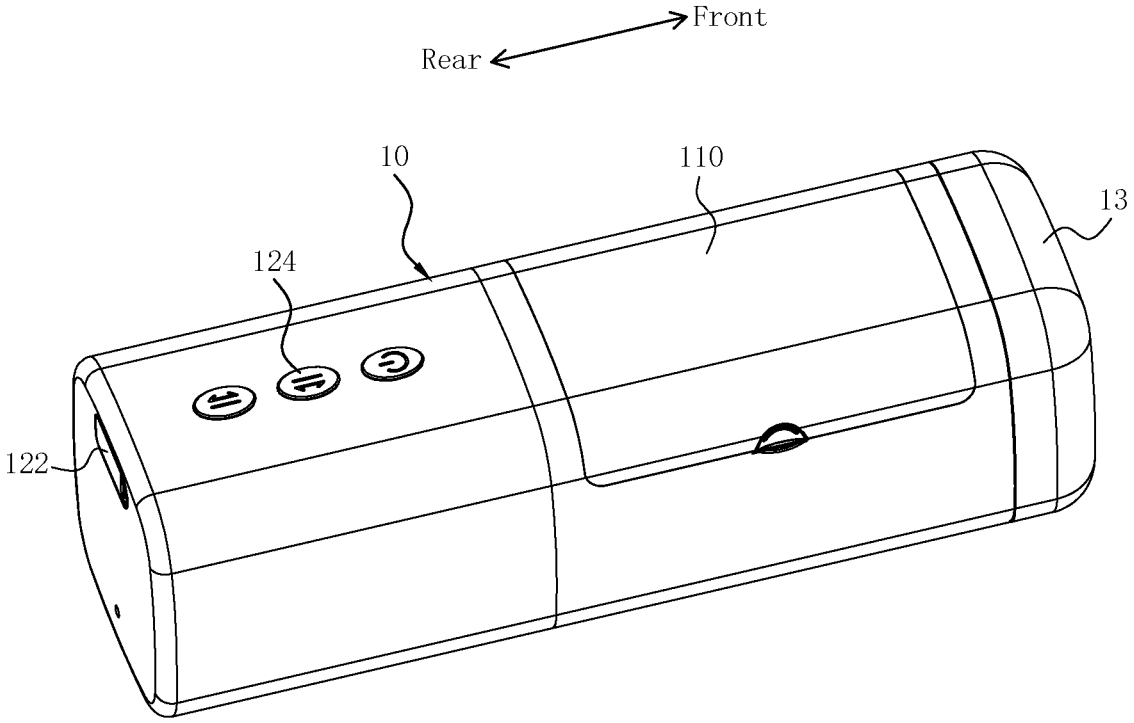
FIG. 1 is a schematic, assembled view of a penis massager according to an embodiment of the present invention.
Figure 2:
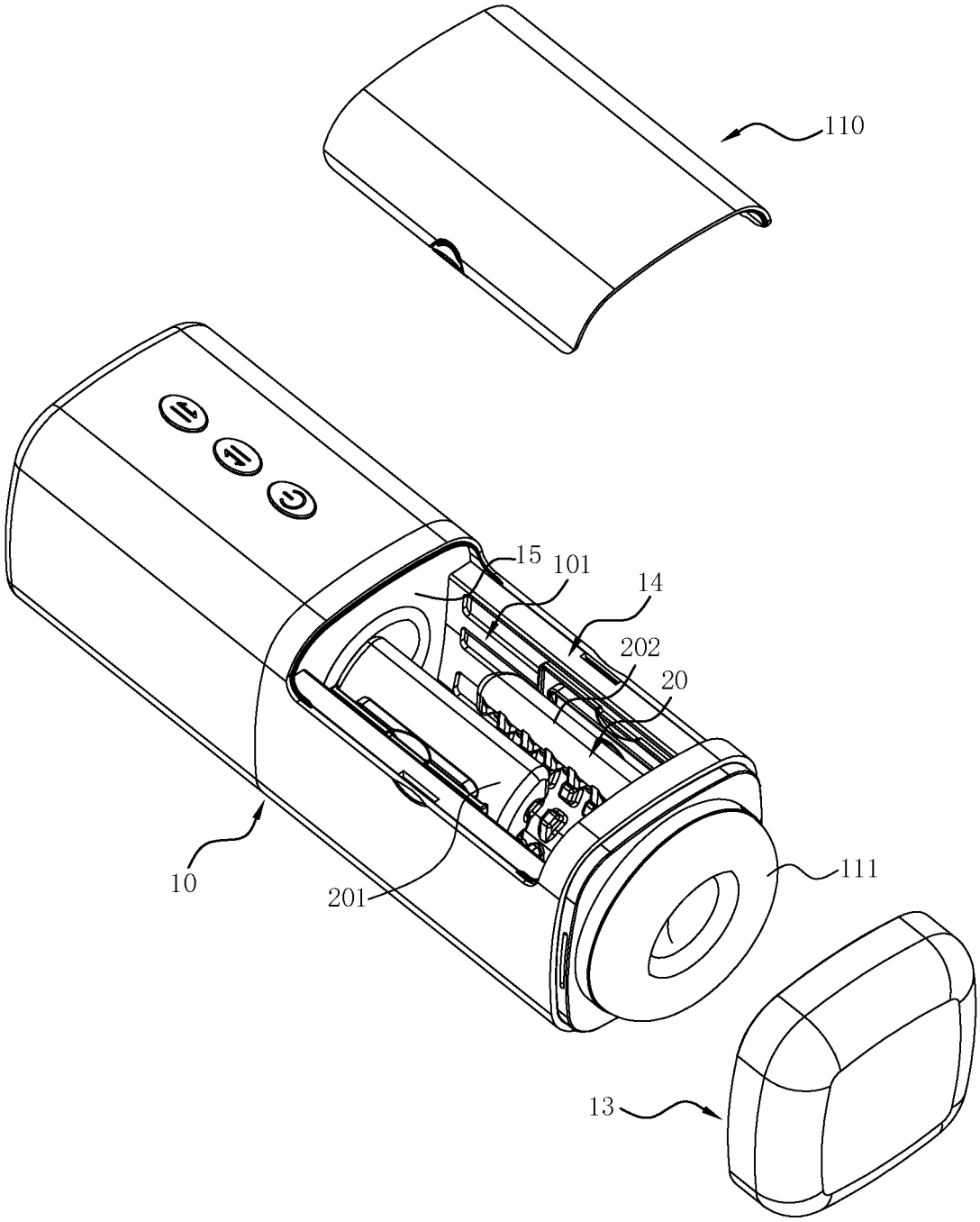
FIG. 2 is an exploded view of the penis massager of FIG. 1.
Figure 3:
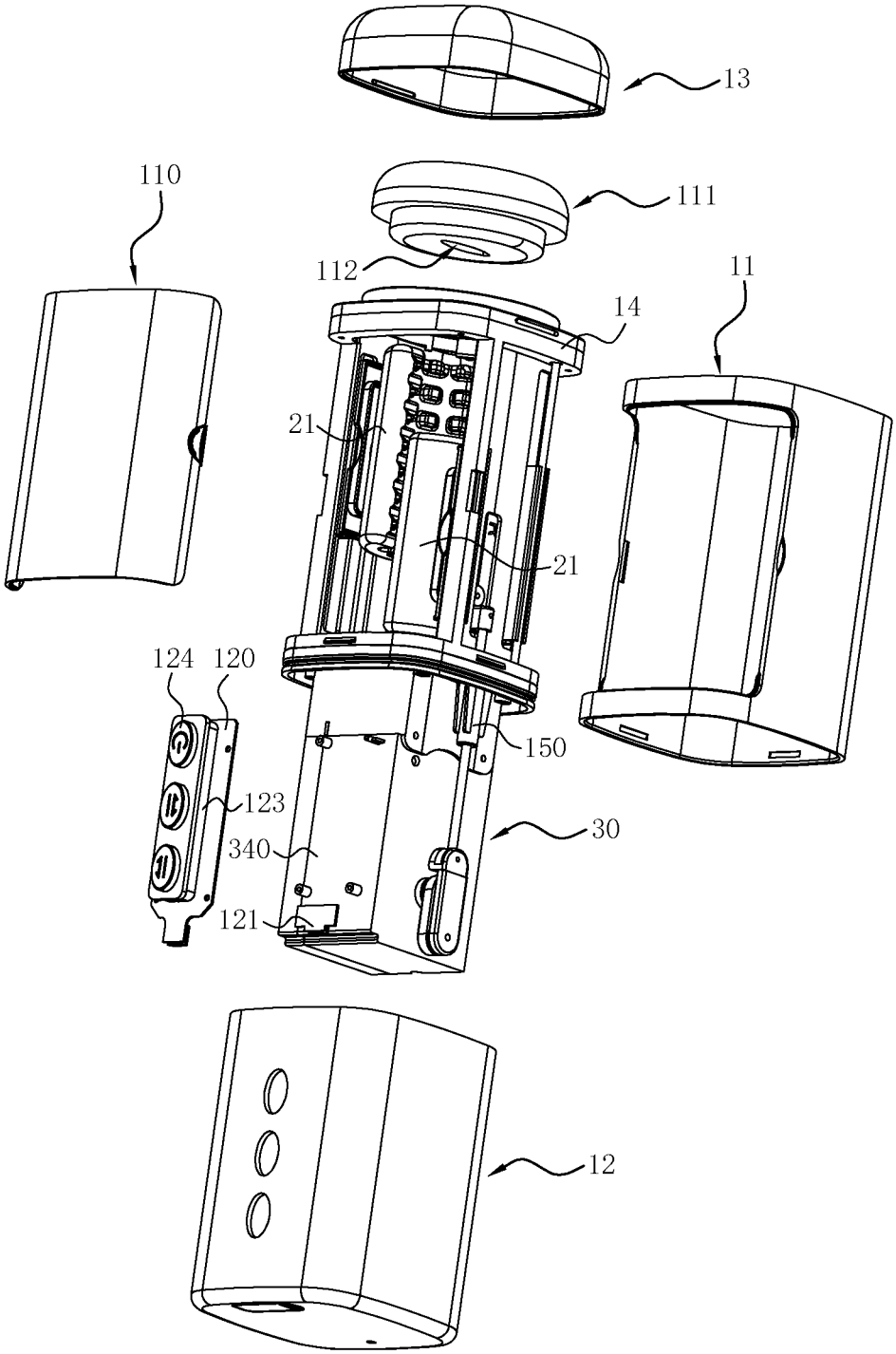
FIG. 3 is another exploded view of the penis massager of FIG. 1.

Referring to FIG. 1 to FIG. 3, a penis massager according to an embodiment of the present invention is shown. The penis massager includes a housing 10, a massager member 20 and a driving apparatus 30. The housing 10 is generally cylindrical-shaped. A front end of the housing 10 defines an accommodating space therein. An end cover 13 is detachably connected to the front end of the housing 10 to seal the accommodating space. A pad 111 is arranged in the accommodating space at the front end of the housing 10, and an inlet 112 for inserting of the penis is provided in the middle of the pad 111. Preferably, the pad 111 is made of soft materials, such as soft rubber.

The massager member 20 and the driving apparatus 30 are both arranged in the housing 10. The massager member 20 includes a first massaging portion 201 and a second massaging portion 202 which are separately arranged. A space for inserting of the penis is defined between the first massaging portion 201 and the second massaging portion 202. That is, the penis extends through the inlet 112 at the front end of the housing 10 into the space between the first massaging portion 201 and the second massaging portion 202. At this time, the penis is clung to inner walls of the first massaging portion 201 and the second massaging portion 202.

The driving apparatus 30 is in transmission connection with the first massaging portion 201 and the second massaging portion 202. The driving apparatus 30 is configured to drive the first massaging portion 201 and the second massaging portion 202 to reciprocate in an axial direction of the housing 10, and a movement direction of the first massaging portion 201 is opposite to that of the second massaging portion 202. In this way, when the penis is inserted into the housing 10, the first massaging portion 201 and the second massaging portion 202 of the massager member 20 can repeatedly rub the penis, which enhances the stimulation intensity of the penis, and in turn improves the user experience.

Compared with the prior art, the penis massager of the present invention has the following beneficial effects: enhancing the stimulation to the male genital and improving the user experience, which is realized in such a way that the massager member 20 and the driving apparatus 30 both are arranged in the housing 10, and the driving apparatus 30 drive the first massaging portion 201 and the second massaging portion 202 of the massager member 20 to reciprocate in the axial direction of the housing 10 to complete the rubbing action of the penis massager 20 to the penis.

Figure 4:
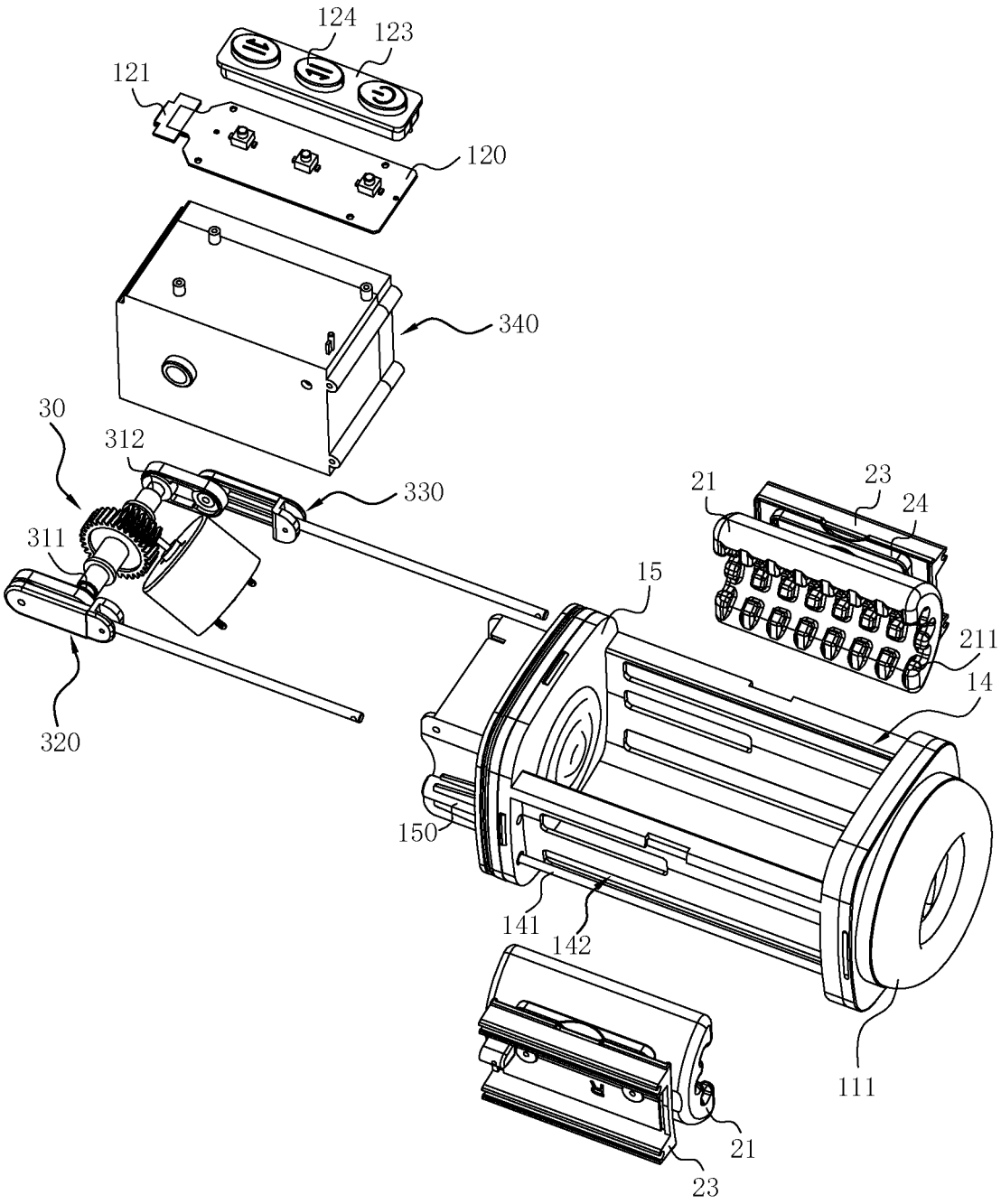
FIG. 4 is a schematic, partially-exploded view of the penis massager of FIG. 1.

With reference to FIG. 2 to FIG. 4, the driving apparatus 30 includes a power source 310. The power source 310 includes a first output shaft 311 and a second output shaft 312 which extend from two different sides. The first output shaft 311 is in transmission connection with the first massaging portion 201 through a first transmission mechanism 320. Alternately, the first transmission mechanism 320 and the first massaging portion 201 may be connected to each other directly or indirectly through other connecting components. The second output shaft 312 is in transmission connection with the second massaging portion 202 through a second transmission mechanism 330. Alternately, the second transmission mechanism 330 and the second massaging portion 202 may be connected to each other directly or indirectly through other connecting components. In particular, the power source 310 may be a structure with one or two motors 313.

Figure 5:
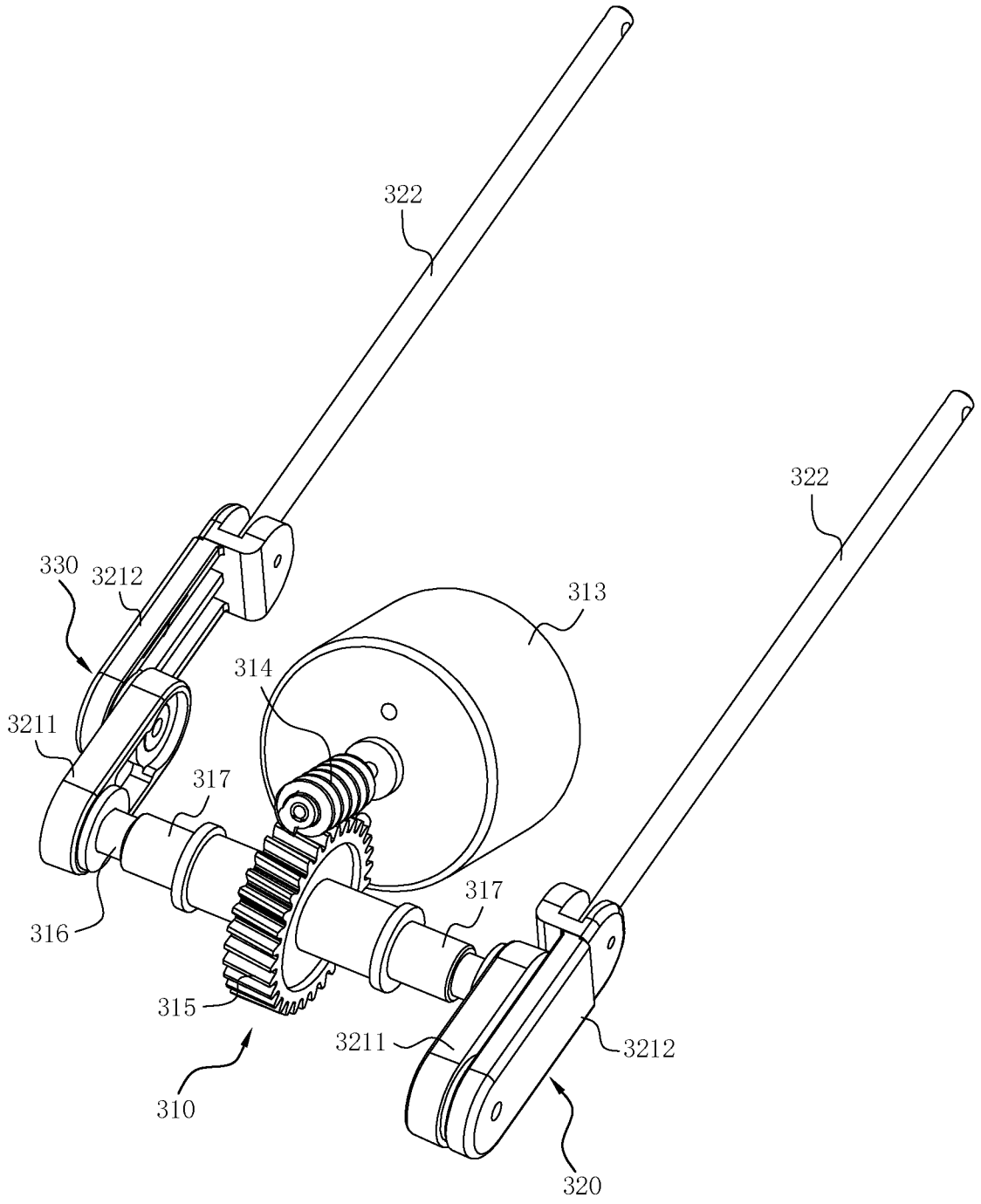
FIG. 5 is a schematic, partial assembled view of the penis massager of FIG. 3.
Figure 6:
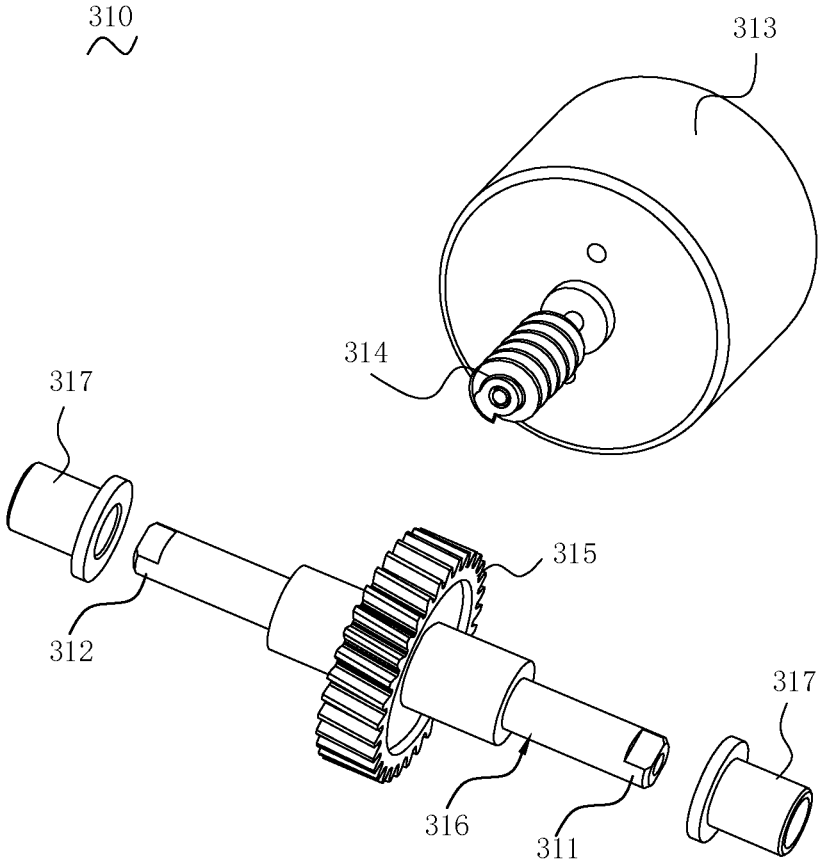
FIG. 6 is a schematic, exploded view of a driving apparatus of the penis massager of FIG. 3.

With reference to FIG. 2, FIG. 5 and FIG. 6, in this embodiment, the driving apparatus 30 is a structure with a single motor. Particularly, the power source 310 includes a motor 313, a worm rod 314, a worm wheel 315 and a transmission shaft 316. The worm wheel 315 is fixedly mounted around the transmission shaft 316. One end of the worm rod 314 is connected to an output shaft of the motor 313. Teeth of the worm rod 314 are meshed with teeth of the worm wheel 315. One end of the transmission shaft 316 acts as the first output shaft 311, and the other end of the transmission shaft 316 acts as the second output shaft 312. An axial direction of the transmission shaft 316 is parallel to a width direction of the housing 10, and an axial direction of the output shaft of the motor 313 is perpendicular to the axial direction of the transmission shaft 316.

When the motor 313 is started, the output shaft of the motor 313 drives the worm rod 314 to rotate, in turn the worm rod 314 drives the worm wheel 315 to rotate, and finally drives the transmission shaft 316 to rotate. One end of the transmission shaft 316 drives the first massaging portion 201 to reciprocate in the axial direction within the housing 10 through the first transmission mechanism 320, and the other end of the transmission shaft 316 drives the second massaging portion 202 to reciprocate in the axial direction within the housing 10 through the second transmission mechanism 330. In this embodiment, the first massaging portion 201 and the second massaging portion 202 are driven by one motor 313, and thus, simple structure and low cost are achieved.

It may be understood that the driving apparatus 30 with a single motor can be provided without the worm rod 314, the worm wheel 315 and the transmission shaft 316, for example, a motor with double output shafts is employed, wherein the double output shafts extending from its two different sides, respectively act as the first output shaft 311 and the second output shaft 312 respectively, which can drive the first massaging portion 201 and the second massaging portion 202 as well.

Particularly, a fixed housing 340 is arranged in the housing 10, and the motor 313 is fixed in the fixed housing 340 with a tail end of the output shaft being arranged obliquely upwards. The worm wheel 315 is connected to and mounted around the middle of the transmission shaft 316. Sleeves 317 are rotatably connected to and mounted around two ends of the transmission shaft 316, respectively. The two ends of the transmission shaft 316 are rotationally connected to the fixed housing 340 through the sleeves 317. Vias configured for mounting the sleeves 317 are provided in the left side and the right side of the fixed housing 340, respectively. One of the sleeves 317 is fixed in the via at the left side of the fixed housing 340 and the other sleeve 317 is fixed in the via at the right side of the fixed housing 340. The ends of the transmission shaft 316 are rotationally connected to the transmission mechanisms on the corresponding sides after extending out from the sleeves 317.

Figure 7:
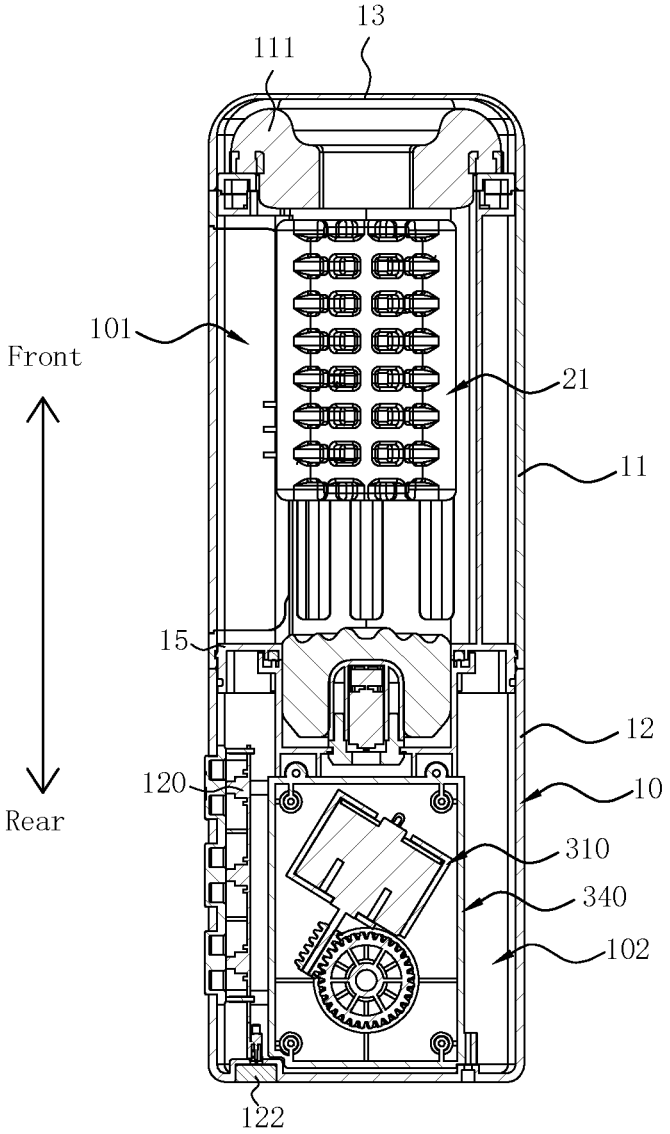
FIG. 7 is a cross sectional view of the penis massager of FIG. 1.

With reference to FIG. 2, FIG. 5 and FIG. 7, a partitioning plate 15 is arranged in the housing 10 and separates an inner cavity of the housing 10 into a first chamber 101 and a second chamber 102. The massager member 20 is accommodated in the first chamber 101, and the power source 310 is accommodated in the second chamber 102. The motor 313, the worm rod 314, the worm wheel 315, the transmission shaft 316 and the fixed housing 340 are accommodated in the second chamber 102.

With reference to FIG. 3 to FIG. 5, in this embodiment, the first transmission mechanism 320 and the second transmission mechanism 330 are the same in structure. Each of the first transmission mechanism 320 and the second transmission mechanism 330 includes a connecting rod assembly 321 and a connecting shaft 322. One end of the connecting rod assembly 321 is rotationally connected to the first output shaft 311 or the second output shaft 312 of the power source 310, and the other end of the connecting rod assembly 321 is hinged with one end of the connecting shaft 322. The other end of the connecting shaft 322 is connected to the first massaging portion 201 or the second massaging portion 202 after sliding through the partitioning plate 15. The connecting shaft 322 is arranged to be parallel to the axial direction of the housing 10. The motor 313 drives the connecting shaft 322 to linearly move through the worm wheel 315, the worm rod 314, the transmission shaft 316 and the connecting rod assembly 321, and in turn drives the first massaging portion 201 and the second massaging portion 202 to reciprocate in the axial direction. It may be understood that the first transmission mechanism 320 and the second transmission mechanism 330 may be different in structures.

The connecting rod assembly 321 may be a structure in the form of two sections. Particularly, the connecting rod assembly 321 includes a first connecting rod 3211 and a second connecting rod 3212. One end of the first connecting rod 3211 is rotationally connected to the first output shaft 311 or the second output shaft 312, one end of the second connecting rod 3212 is hinged with the other end of the first connecting rod 3211, and the other end of the second connecting rod 3212 is hinged with one end of the connecting shaft 322. In this way, a rotary motion of the transmission shaft 316 is converted into a linear motion through the connecting rod assembly 321. That is, the connecting rod assembly 321 drives the connecting shaft 322 to move linearly, and in turn drives the first massaging portion 201 and the second massaging portion 202 to reciprocate in an axial direction.

The massager member 20 may be an integrated structure or a split structure.

In this embodiment, the massager member 20 is an integrated structure. Particularly, the massager member 20 is cylindrical-shaped. The first massaging portion 201 and the second massaging portion 202 of the massager member 20 are two seperate portions on an inner wall of the massager member 20, and the first massaging portion 201 and the second massaging portion 202 are axially retractable relative to the massager member 20. That is, the massager member 20 is an integrated structure. An outer wall of the massager member 20 is made of a hard material and is fixedly connected to the housing 10. The first massaging portion 201 and the second massaging portion 202 on the inner wall of the massager member 20 are elastic and retractable axially relative to the outer wall of the massager member 20. When the driving apparatus 30 is started, the outer wall of the massager member 20 does not move while the first massaging portion 201 and the second massaging portion 202 which are separately arranged inside the massager member 20 are retractable axially to repeatedly perform the rubbing action on the penis inserted into the massager member 20.

With reference to FIG. 2 to FIG. 4 and FIG. 7, in this embodiment, the massager member 20 is a split structure. Particularly, the massager member 20 includes two pads 21 arranged in the housing 10 and spaced from each other in a width direction of the housing 10. The two pads 21 each have a C-shaped cross section. The two pads 21 are slidably arranged in the housing 10. One pad 21 acts as the first massaging portion 201 and the other pad 21 acts as the second massaging portion 202. The driving apparatus 30 is in transmission with the two pads 21, so as to drive the two pads 21 to reciprocate in an axial direction within the first chamber 101 of the housing 10.

Preferably, a plurality of massaging bulges 211 are provided on inner wall surfaces of the two pads 21 respectively, which can improve the massaging effect on the penis.

Particularly, a mounting frame 14 is arranged in the housing 10, and the two pads 21 are slidably connected to two different sides of the mounting frame 14, respectively. As shown in FIG. 2, the mounting frame 14 has a generally U-shaped longitudinal cross section, and the two pads 21 are arranged on the left side and the right side of the mounting frame 14 at intervals.

With reference to FIG. 2 to FIG. 4, preferably, sliding blocks 23 are respectively slidably connected to two different sides of the mounting frame 14, and the two pads 21 are respectively detachably connected onto the sliding blocks 23 on two sides. The driving apparatus 30 is in transmission connection with the sliding blocks 23, such that when the driving apparatus 30 drives the sliding blocks 23 to slide back and forth on the mounting frame 14, the two pads 21 are driven to reciprocate in the axial direction to complete the rubbing action on the penis.

Mounting blocks 235 are convexly arranged on outer side walls of the sliding blocks 23. The front ends of the connecting shafts 322 are fixedly connected to the mounting blocks 235 by screws. In this way, the connecting shafts 322 are fixedly connected to the sliding blocks 23. The partitioning plate 15 is provided with through holes for sliding of the connecting shafts 322 therethrough, and a rear side of the partitioning plate 15 is provided with extending sections 150 in the through holes, and the connecting shafts 322 are matched with the extending sections 150 in a sliding manner. The extending sections 150 may be integrally formed with the partitioning plate 15, or the extending sections 150 may be fixed onto the partitioning plate 15 by screws. The guidance of the connecting shafts 322 may be improved by the extending sections 150 on the partitioning plate 15, such that the connecting shafts 322 can stably move back and forth in a direction parallel to the axis direction of the housing 10.

Figure 8:
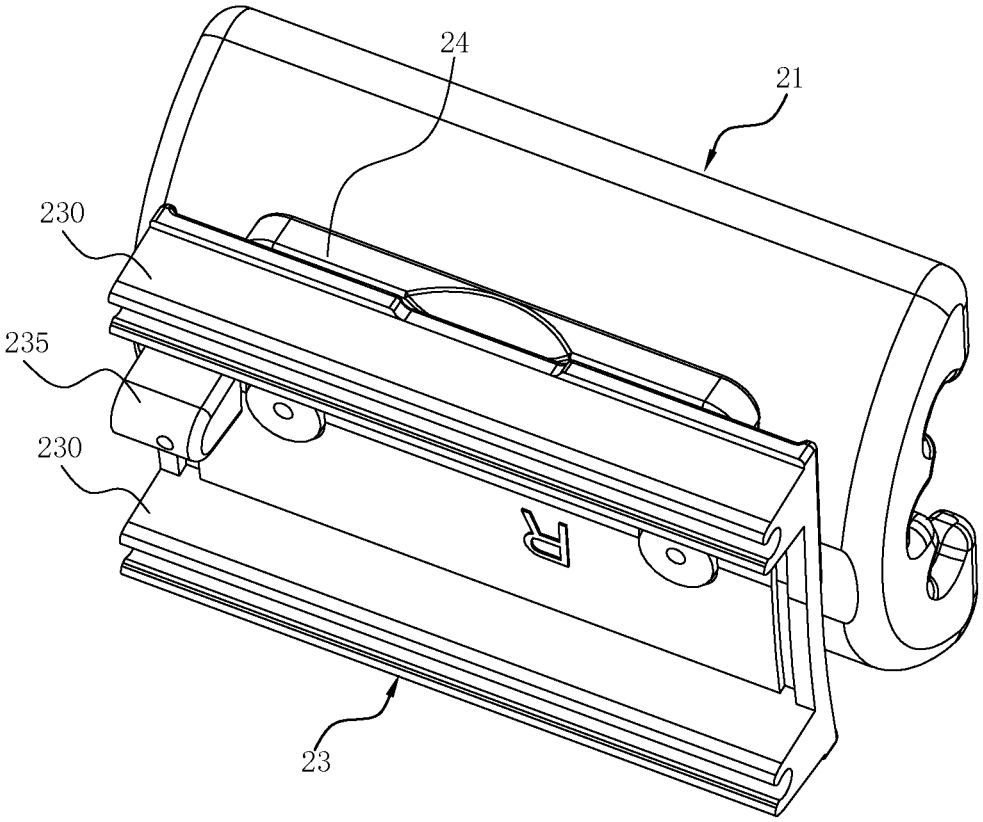
FIG. 8 is an assembled view of a massager member and a sliding block of the penis massager of FIG. 4.

With reference to FIG. 2, FIG. 4 and FIG. 8, sliding rods 141 are respectively arranged on two different outer sides of the mounting frame 14. One end of each sliding rod 141 is fixed to a rear side of a front end of the mounting frame 14, and the other end of each sliding rod 141 is fixed to a front side of the partitioning plate 15. Strip-shaped holes 142 are provided in positions of the mounting frame 14 corresponding to the sliding rods 141. Connecting portions 230 are disposed on outer side walls of the sliding blocks 23, and the connecting portions are slidably connected to the sliding rods 141 after passing through the strip-shaped holes 142. In this embodiment, two sliding rods 141 are disposed on the left side and the right side of the mounting frame 14 respectively, one sliding rod 141 is close to a bottom of the mounting frame 14, and the other sliding rod 141 is close to a top of the mounting frame 14. The sliding blocks 23 are slidably mounted on the mounting frame 14 through the upper sliding rod and the lower sliding rod 141. In this way, when the driving apparatus 30 drives the sliding blocks 23 to slide back and forth on the mounting frame 14, the massager member 20 is driven to reciprocate in the axial direction of the housing 10.

With reference to FIG. 1 to FIG. 3 and FIG. 7, the housing 10 includes a front housing 11 and a rear housing 12 connected to the front housing 11. The front housing 11 is located at a front side of the rear housing 12, and the partitioning plate 15 is located at a rear end of the front housing 11. The front housing 11 forms the first chamber 101 in a surrounding manner, and the second chamber 102 is formed between the rear housing 12 and the partitioning plate 15 in a surrounding manner. The front end of the front housing 11 has an accommodating space, and an end cover 13 covers the accommodating space at the front end of the front housing 11. A surface cover 110 is detachably mounted on a top surface of the front housing 11. After the surface cover 110 is removed, the massager member 20 may be removed from the front housing 11.

The rear housing 12 is internally provided with a circuit board 120 and a rechargeable battery. The rechargeable battery and the motor 313 are both electrically connected to the circuit board 120. A charging interface 121 is disposed at a rear end surface of the rear housing 12, and a flexible sealing cover 122 is arranged at the charging interface 121. The sealing cover 122 may be rotationally opened or closed. When the sealing cover 122 is opened, the rechargeable battery may be charged through the charging interface 121. The rear housing 12 is provided with a control panel 123, a plurality of function keys 124 extending from a top surface of the rear housing 12 are arranged on the control panel 123, such as an on/off key, a power add/subtract key, and the like.

Figure 9:
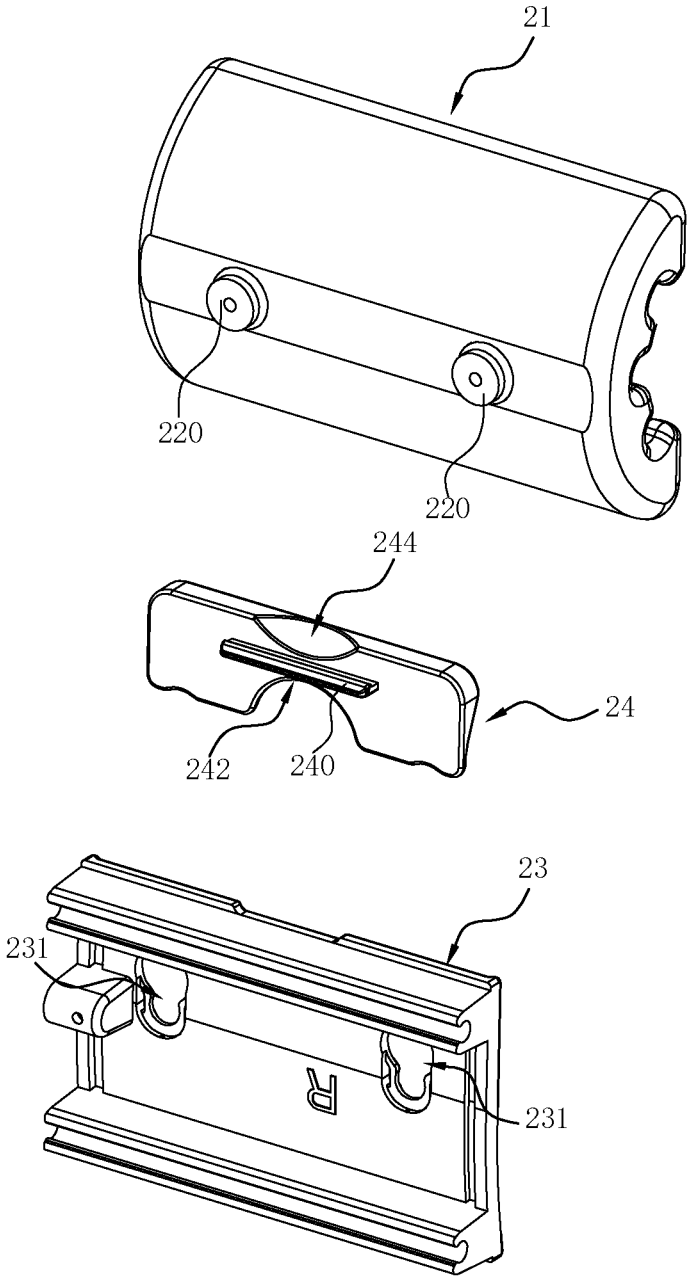
FIG. 9 is an exploded view of the massager member and the sliding block of FIG. 8.
Figure 10:
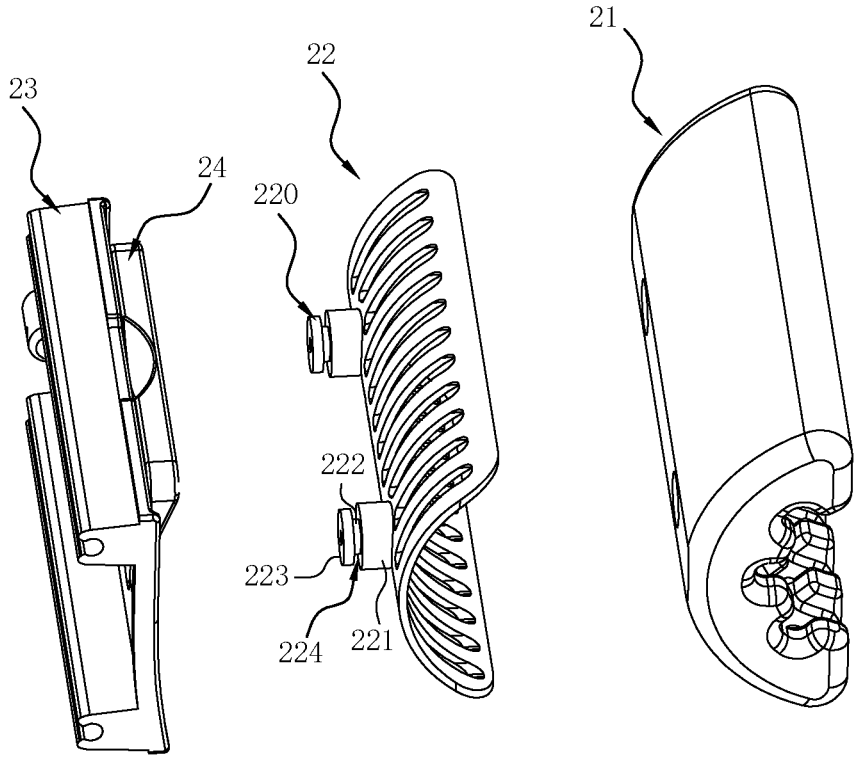
FIG. 10 is another exploded view of the massager member and the sliding block of FIG. 8.

With reference to FIG. 8 to FIG. 10, a fixed frame 22 is embedded in inner walls of the pads 21. The fixed frame 22 has clamping blocks 220 extending out from outer wall surfaces of the pads 21. The clamping blocks 220 are detachably connected to the sliding blocks 23, and the clamping blocks 220 and the sliding blocks 23 may be connected by snapping-fit, or by a connecting member or other connecting components. In this embodiment, the fixed frame 22 and the pads 21 are integral by injection molding. The fixed frame 22 is provided with a plurality of spaced strip-shaped holes which make the fixed frame 22 be a hollow structure. In this way, the fixed frame 22 may be stably engaged with the pads 21 after injection molding.

Particularly, the fixed frame 22 has a plurality of clamping blocks 220 arranged at intervals. In this embodiment, the fixed frame 22 is provided with two clamping blocks 220 at intervals, such that the pads 21 may be stably mounted on the sliding blocks 23, and the difficulty of mounting the pads 21 may be reduced.

Particularly, inserting blocks 24 are snapped on the sliding blocks 23. The sliding blocks 23 are provided with a plurality of through holes 231, and the through holes 231 are in one-to-one correspondence with the clamping blocks 220. The clamping blocks 220 are inserted into the through holes 231 in the corresponding positions. One end of each of the inserting blocks 24 abuts against the clamping block 220, and the inserting blocks 24 are configured to fix the clamping blocks 220 at the corresponding through holes 231 of the sliding blocks 23.

During assembly, the clamping blocks 220 of the fixed frame 22 are aligned with the corresponding through holes 231 of the sliding blocks 23, and the inserting blocks 24 are snapped on the sliding blocks 23 after the clamping blocks 220 are inserted into the corresponding through holes 231. At this time, the inserting blocks 24 are located between the sliding blocks 23 and the pads 21, and the clamping blocks 220 abut against the through holes 231 of the sliding blocks 23 by means of the inserting blocks 24, such that fixed assembly between the fixed frame 22 and the sliding blocks 23 is achieved, and further, fixed assembly between the pads 21 and the sliding blocks 23 is achieved. In this embodiment, two clamping blocks 220 are arranged on the fixed frame 22 at intervals, bottom ends of the inserting blocks 24 abut against the two clamping blocks 220, and further, the clamping blocks 220 abut against the through holes 231 of the sliding blocks 23.

Preferably, the sliding blocks 23 are provided with engaging portions 232 at the through holes 231, and annular grooves 224 are provided in outer peripheral walls of the clamping blocks 220, the annular grooves 224 have a width matching with the engaging portions 232. The engaging portions 232 are inserted into the annular grooves 224, and the engaging portions 232 are in clearance fit with the annular grooves 224. By means of the clearance fit of the engaging portions 232 and the annular grooves 224, the fixed frame 22 is more stable after being mounted on the sliding blocks 23, and the pads 21 will not shake leftwards and rightwards during movement.

With reference to FIG. 10 to FIG. 13. In this embodiment, the clamping blocks 220 are column-shaped as a whole. Each of the clamping blocks 220 includes a large-diameter end 221, a connecting section 222 and a small-diameter end 223 which are connected in turn, all of them are column-shaped and are arranged coaxially. A diameter of the large-diameter end 221 is greater than that of the small-diameter end 223, and the diameter of the small-diameter end 223 is greater than that of the connecting section 222. One end of the large-diameter end 221 is connected to the fixed frame 22. An annular groove 224 is formed between the large-diameter end 221 and the small-diameter end 223 around the connecting section 222. The small-diameter end 223 is inserted into the through hole 231 of the sliding block 23. The large-diameter end 221 is located inside the sliding block 23 and is not inserted into the through hole 231. The through hole 231 of the sliding block 23 is generally in a shape of a runway. A length of the through hole 231 in an up-down direction is greater than a width in a left-right direction.

Two sides of each of the engaging portions 232 are opened. A bottom of each of the engaging portions 232 forms a profile suitable for the small-diameter end 223 of the clamping block 220 to pass through. Two arc-shaped clamping accommodating spaces 241 are spaced at bottoms of the inserting blocks 24, and the clamping accommodating spaces 241 of the inserting blocks 24 abut against the outer peripheral walls of the large-diameter ends 221 of the inserting blocks 220. During assembly, the small-diameter ends 223 of the clamping blocks 220 are inserted from the tops of the through holes 231, and then, the clamping blocks 220 moves downwards to make the annular grooves 224 of the clamping blocks 220 be clamped on the engaging portions 232, and then, the inserting blocks 24 are inserted to a position between the sliding blocks 23 and the pads 21, so that the inserting blocks 24 are snapped on the sliding blocks 23. In this way, a mounting operation between the pads 21 and the sliding blocks 23 is completed.

Figure 14:
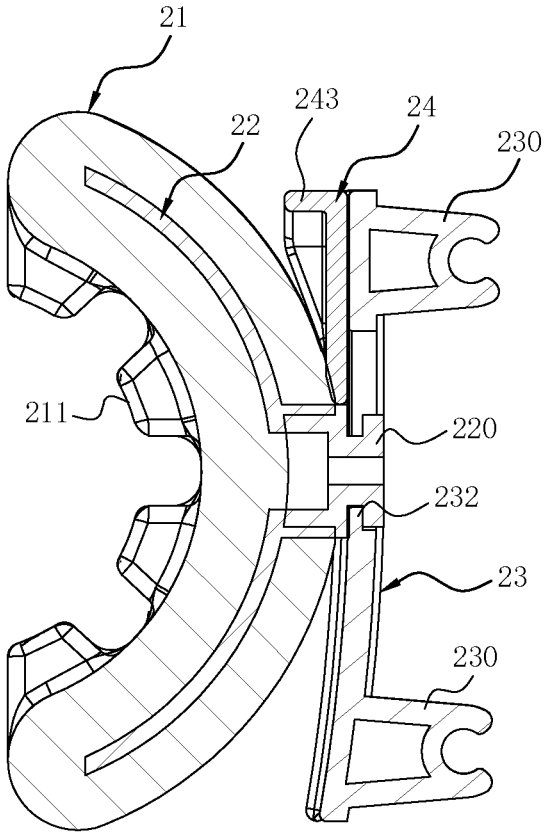
FIG. 14 is a cross sectional view taken along line A-A of FIG. 13.

With reference to FIG. 9, FIG. 10 and FIG. 14, clamping grooves 233 are provided in inner wall surfaces of the sliding blocks 23, inverted buckles 240 connected to the clamping grooves 233 in a snap-fit manner are disposed on positions of outer side walls near tops of the inserting blocks 24, and hooking portions of the inverted buckles 240 are located on upper sides thereof. The inserting blocks 24 are detachably connected to the sliding blocks 23 in a snap-fit manner. When the pads 21 are required to be removed, firstly, the inserting blocks 24 are removed from the sliding blocks 23, and then, the clamping blocks 220 of the fixed frame 22 are removed from the sliding blocks 23.

In this way, the pads 21 are removed from the sliding blocks 23. It may be understood that the sliding blocks 23 may be detachably connected to the clamping blocks 220 of the fixed frame 22 in other manners. For example, a locking mechanism is arranged on each of the sliding blocks 23. Each of the locking mechanisms has a locking state and an unlocking state. When the locking mechanism is in the locking state, the locking mechanism will clamp the clamping blocks 220 of the fixed frame 22 onto the sliding blocks 23. When the locking mechanism is in the unlocking state, the clamping blocks 220 of the fixed frame 22 may be removed from the sliding blocks 23, and in turn, the pads 21 may be removed from the sliding blocks 23.

Figure 11:
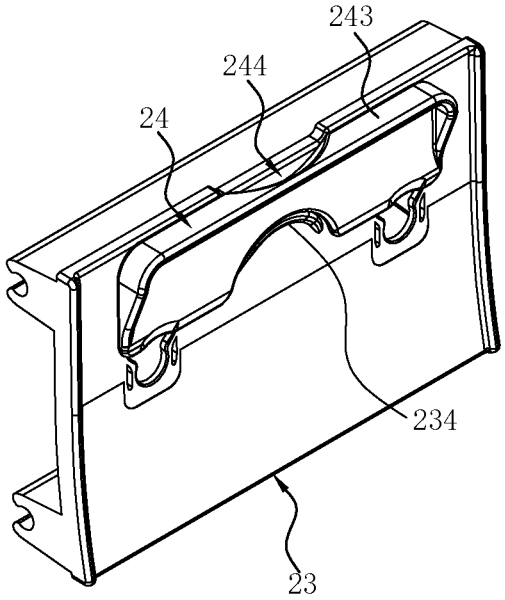
FIG. 11 is an assembled view of a sliding block of the penis massager of FIG. 4.
Figure 12:
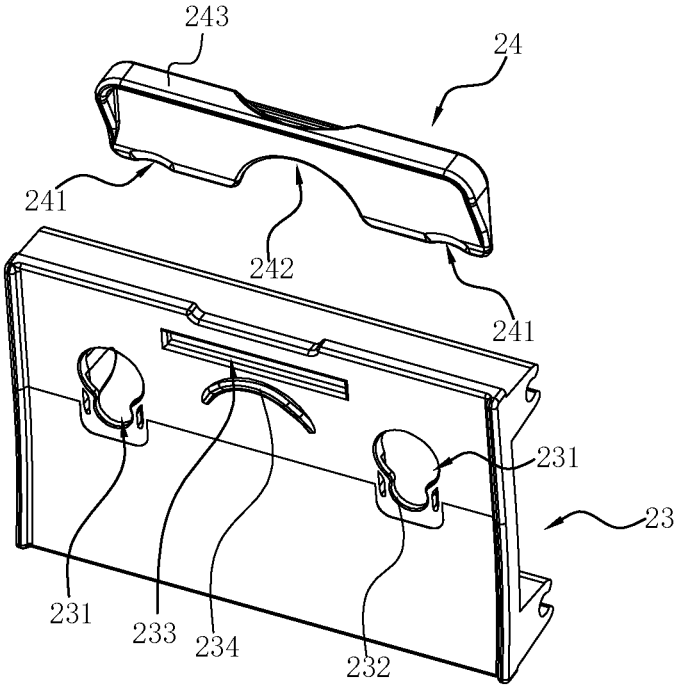
FIG. 12 is an exploded view of the sliding block of the penis massager of FIG. 4.
Figure 13:
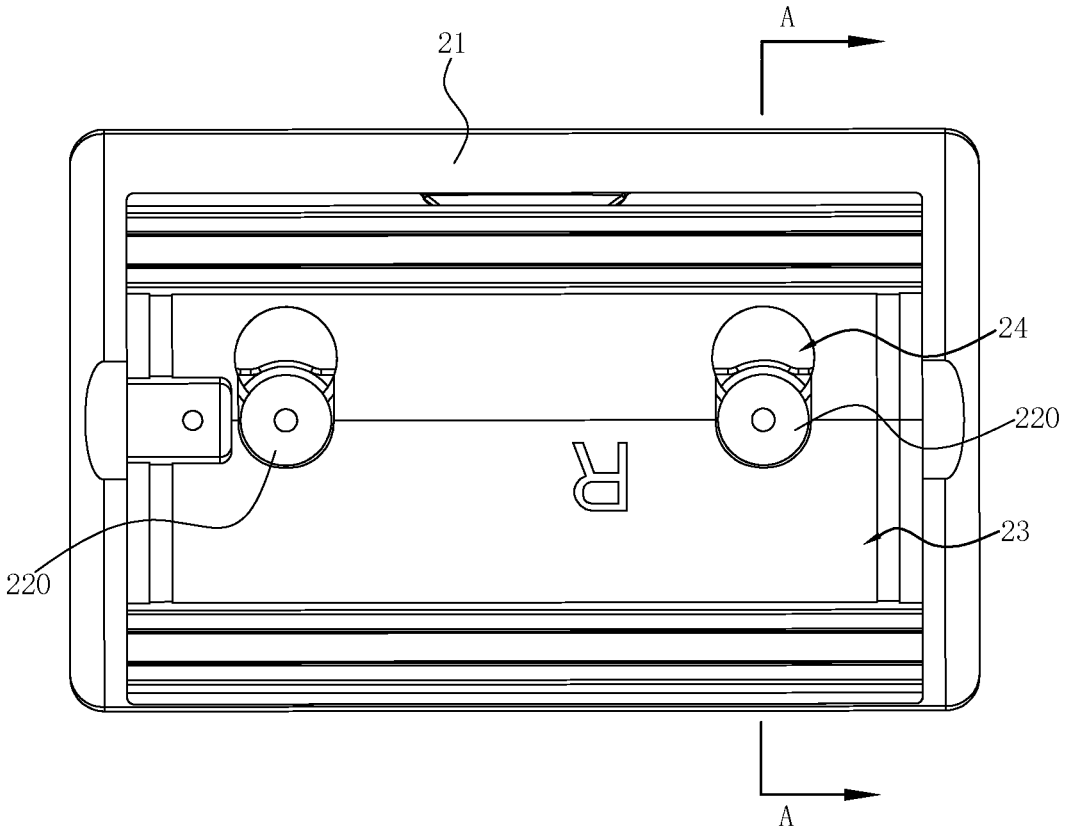
FIG. 13 is a side view of the massager member and the sliding block of the penis massager of FIG. 4.

With reference to FIG. 4, FIG. 11 and FIG. 12, notches 242 are provided in bottoms of the inserting blocks 24. Convex portions 234 matched with the notches 242 of the inserting blocks 24 in terms of profiles are disposed on inner side walls of the sliding blocks 23, and the notches 242 of the inserting blocks 24 abut against the convex portions 234. When the tops of the inserting blocks 24 are connected to the sliding blocks 23 in a snap-fit manner, the bottoms of the inserting blocks 24 just abut against the convex portions 234 of the sliding blocks 23, and thus the inserting blocks 24 may be more stably mounted on the sliding blocks 23. When the sliding blocks 23 slide back and forth on the mounting frame 14, the inserting blocks 24 are not easy to loosen or fall off. In this embodiment, the notches 242 in the bottoms of the inserting blocks 24 are arc-shaped, and the top surfaces of the convex portions 234 are arc-shaped, which facilitates the operation of connecting the inserting blocks 24 to the sliding blocks 23 in a snap-fit manner.

With reference to FIG. 9, FIG. 11 and FIG. 14, surrounding edges 243 are disposed at positions of inner side walls near tops of the inserting blocks 24. In this way, the inserting blocks 24 may be easily removed from the sliding blocks 23 through the surrounding edges 243, and then the pads 21 may be removed from the sliding blocks 23. Preferably, notches are provided in tops of the sliding blocks 23, arc-shaped grooves 244 concaved downwards are provided in positions of tops of the inserting blocks 24 corresponding to the notches, the arc-shaped grooves 244 extend to top surfaces of the surrounding edges 243. As such, when the inserting blocks 24 are removed from the sliding blocks 23 with two fingers in a buckling manner, part of one of the fingers is located in the arc-shaped grooves 244, and the other finger is buckled up on the surrounding edges 243, such that the inserting blocks 24 may be easily pulled out of the sliding blocks 23.

That is, by means of the notches in the tops of the sliding blocks 23 and the arc-shaped grooves 244 in the inserting blocks 24, the fingers can conveniently extend and exert a force to the inserting blocks 24, thereby reducing the difficulty of removing the inserting blocks 24 from the sliding blocks 23. In this embodiment, the surrounding edges 243 of the inserting blocks 24 extend from tops to bottoms of the inserting blocks 24, and portions of the surrounding edges 243 extending to the bottoms are set as a gradual structure, and the width of the gradual structure gradually decreases from the top to the bottom. The bottom of the surrounding edge 243 of this part is clung to the outer wall surface of the pad 21, and a gap exists between the top of the surrounding edge 243 of this part and the outer wall surface of the pad 21, which makes the overall structure of the sliding block 23 and the pad 21 compact enough after assembly. At the same time, the inserting block 24 may be easily removed from the sliding block 23 in a buckling manner.

Figure 15:
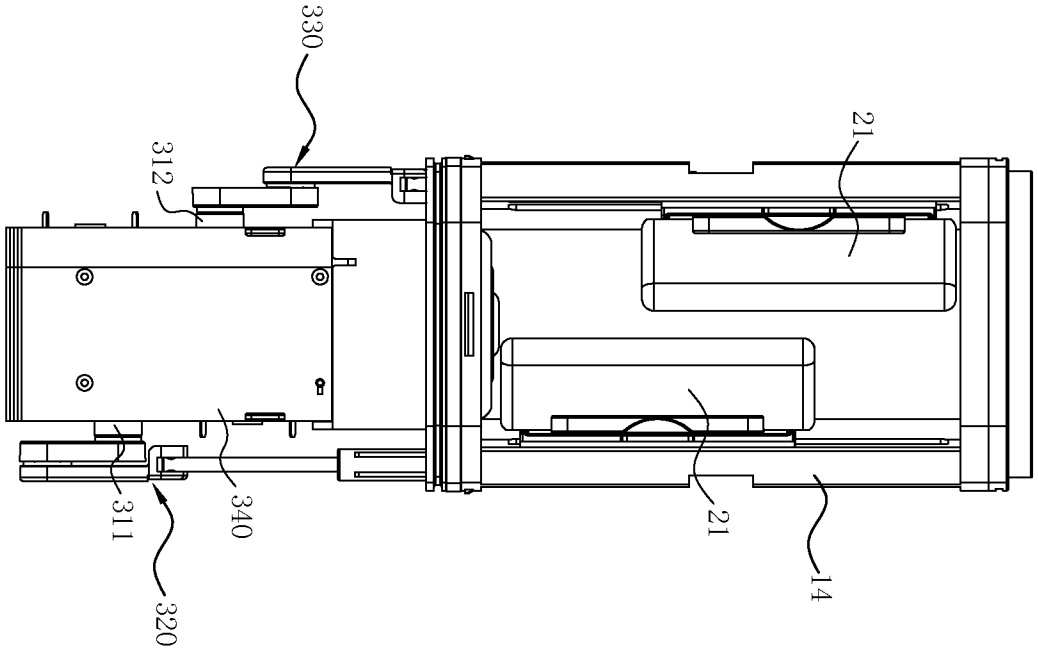
FIG. 15 is a schematic, side view of a penis massager according to another embodiment of the present invention.
Figure 16:
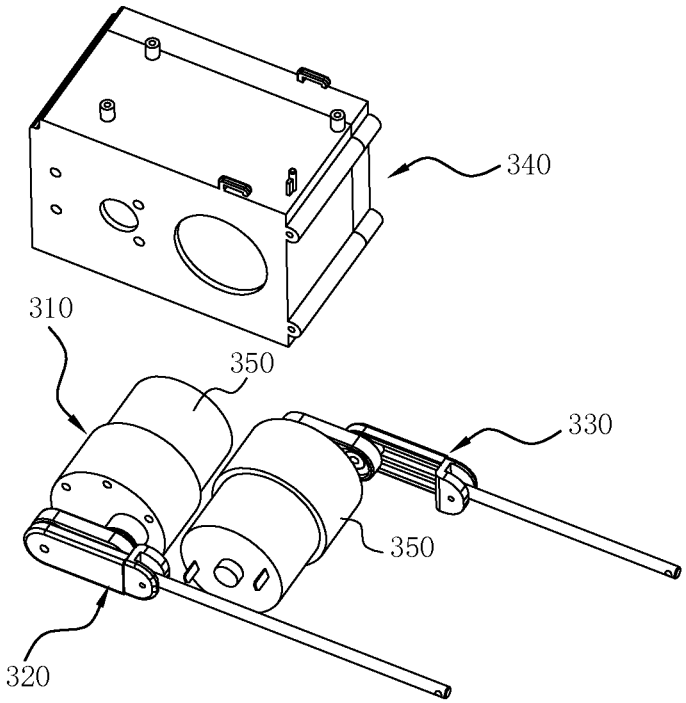
FIG. 16 is an exploded view of the penis massager of FIG. 15.
Figure 16:
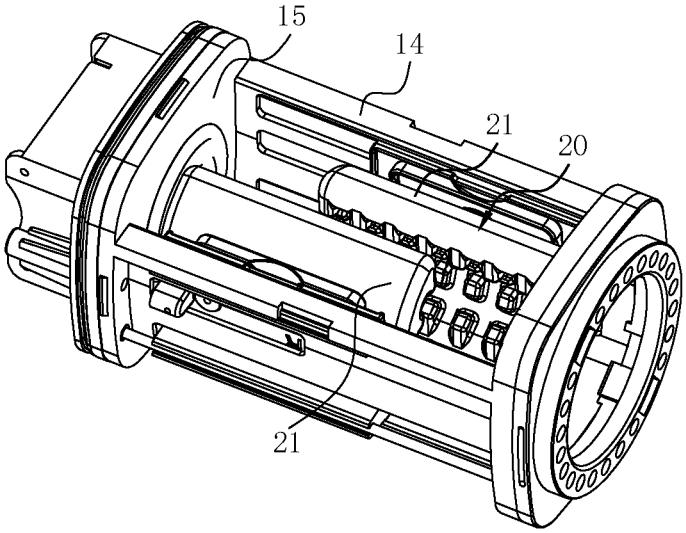

With reference to FIG. 15 and FIG. 16, in this embodiment, the driving apparatus 30 of the penis massager is a structure with two motors. The two motors 350 are spaced in the second chamber of the housing. The two motors 350 are transversely fixed in the fixed housing 340 at intervals, and the output shafts of the two motors 350 extend out from the left side and the right side, respectively. The output shaft of one motor 350 extending from the left side of the fixed housing 340 is rotationally connected to the first transmission mechanism 320, and the output shaft of the other motor 350 extending from the right side of the fixed housing 340 is rotationally connected to the first transmission mechanism 330. The output shaft of one motor 350 acts the first output shaft 311, and the output shaft of the other motor 350 acts the second output shaft 312.

The above is only a better embodiment of the present invention and is not intended to limit the present invention. Any modification, equivalent replacement and improvement made within the spirit and principle of the present invention shall be included in a scope of protection of the present invention.

What is claimed is:

1. A penis massager, comprising:

a housing;

a massager member comprising a first massaging portion and a second massaging portion which are separately arranged, and a space for inserting of a penis being defined between the first massaging portion and the second massaging portion; and a driving apparatus arranged in the housing, the driving apparatus being in transmission connection with the first massaging portion and the second massaging portion respectively for driving the first massaging portion and the second massaging portion to reciprocate in an axial direction of the housing, a movement direction of the first massaging portion being opposite to that of the second massaging portion.

2. The penis massager according to claim 1, wherein the driving apparatus comprises a power source which has a first output shaft and a second output shaft extending from two different sides thereof, the first output shaft is in transmission with the first massaging portion through a first transmission mechanism, and the second output shaft is in transmission with the second massaging portion through a second transmission mechanism.

3. The penis massager according to claim 2, wherein the power source comprises a motor, a worm rod, a worm wheel and a transmission shaft, the worm wheel is fixedly mounted around the transmission shaft, one end of the worm rod is connected to an output shaft of the motor, the worm rod is meshed with the worm wheel, and two ends of the transmission shaft act as the first output shaft and the second output shaft, respectively.

4. The penis massager according to claim 2, wherein the power source comprises a motor which has two output shafts that respectively extend from two different sides to form the first output shaft and the second output shaft.

5. The penis massager according to claim 2, wherein a partitioning plate is mounted in the housing and separates an internal of the housing into a first chamber and a second chamber, the massager member is accommodated in the first chamber, and the power source is accommodated in the second chamber.

6. The penis massager according to claim 5, wherein each of the first transmission mechanism and the second transmission mechanism comprises a connecting rod assembly and a connecting shaft, one end of the connecting rod assembly of the first transmission mechanism is rotationally connected to the first output shaft another end of the connecting rod assembly of the first transmission mechanism is hinged with one end of the connecting shaft of the first transmission mechanism, and another end of the connecting shaft of the first transmission mechanism extends through the partitioning plate to connect the first massaging portion, one end of the connecting rod assembly of the second transmission mechanism is rotationally connected to the second output shaft, another end of the connecting rod assembly of the second transmission mechanism is hinged with one end of the connecting shaft of the second transmission mechanism, and another end of the connecting shaft of the second transmission mechanism extends through the partitioning plate to connect the second massaging portion.

7. The penis massager according to claim 6, wherein the connecting rod assembly of the first transmission mechanism or the second transmission mechanism comprises a first connecting rod and a second connecting rod, one end of the first connecting rod of the first transmission mechanism is rotationally connected to the first output shaft, one end of the second connecting rod of the first transmission mechanism is hinged with another end of the first connecting rod of the first transmission mechanism, and another end of the second connecting rod of the first transmission mechanism is hinged with the one end of the connecting shaft of the first transmission mechanism, one end of the first connecting rod of the second transmission mechanism is rotationally connected to the second output shaft, one end of the second connecting rod of the second transmission mechanism is hinged with another end of the first connecting rod of the second transmission mechanism, and another end of the second connecting rod of the second transmission mechanism is hinged with the one end of the connecting shaft of the second transmission mechanism.

8. The penis massager according to claim 1, wherein the penis massager is substantially cylindrical-shaped, the first massaging portion and the second massaging portion are two portions on an inner wall of the penis massager, and the first massaging portion and the second massaging portion are axially retractable relative to the penis massager.

9. The penis massager according to claim 1, wherein the penis massager comprises two pads slidably mounted in the housing and spaced from each other, the two pads each have a C-shaped cross section, and the two pads act as the first massaging portion and the second massaging portion, respectively.

10. The penis massager according to claim 9, wherein a plurality of massaging bulges are provided on inner wall surfaces of the two pads, respectively.

11. The penis massager according to claim 9, wherein a mounting frame is fixed in the housing, and the two pads are slidably connected to two sides of the mounting frame.

12. The penis massager according to claim 11, wherein a plurality of sliding blocks are slidably connected to the two sides of the mounting frame respectively, the two pads are detachably connected to the plurality of sliding blocks on the two sides, and the driving apparatus is in transmission connection with the plurality of sliding blocks.

13. The penis massager according to claim 12, wherein a plurality of sliding rods are arranged on two different outer sides of the mounting frame respectively, a plurality of strip-shaped holes are provided in positions of the mounting frame corresponding to the plurality of sliding rods of the mounting frame, a plurality of connecting portions are provided on outer side walls of the plurality of sliding blocks, and each of the plurality of connecting portions extends through one of the plurality of strip-shaped holes to slidably connect one of the plurality of sliding rods.

14. The penis massager according to claim 12, wherein a fixed frame is embedded in an inner wall of each of the two pads, each of the fixed frames comprises at least one clamping block extending out of an outer wall surface of a corresponding pad, and the at least one clamping block is detachably connected to the plurality of sliding blocks, respectively.

15. The penis massager according to claim 14, wherein the at least one clamping block of each of the fixed frames comprises a plurality of clamping blocks that are arranged at intervals.

16. The penis massager according to claim 15, wherein a plurality of inserting blocks are respectively snapped on the plurality of sliding blocks, the plurality of sliding blocks are provided with a plurality of through holes, the plurality of through holes are in one-to-one correspondence with the plurality of clamping blocks, the plurality of clamping blocks are inserted into the plurality of through holes in corresponding positions, one end of each of the plurality of inserting blocks abutting against one of the plurality of clamping blocks to fix the plurality of clamping blocks at corresponding through holes of the plurality of sliding blocks.

17. The penis massager according to claim 16, wherein the plurality of sliding blocks are provided with a plurality of engaging portions at the plurality of through holes, annular grooves are provided in outer peripheral walls of the plurality of clamping blocks with a width matching with the plurality of engaging portions, and the plurality of engaging portions are inserted into the annular grooves.

18. The penis massager according to claim 16, wherein a plurality of clamping grooves are provided in inner side walls of the plurality of sliding blocks, and inverted buckles snapped in the plurality of clamping grooves are disposed on outer side walls of the plurality of inserting blocks at positions near tops of the outer side walls.

19. The penis massager according to claim 16, wherein a plurality of notches are provided in bottoms of the plurality of inserting blocks, convex portions matched with the plurality of notches in terms of profiles are disposed on inner side walls of the plurality of sliding blocks, and the plurality of inserting blocks abut against the convex portions at positions thereof with the plurality of notches.

20. The penis massager according to claim 16, wherein a plurality of surrounding edges are disposed at positions near tops of inner side walls of the plurality of inserting blocks to bring a convenience to remove the plurality of inserting blocks from the plurality of sliding blocks by means of the plurality of surrounding edges.

* * * * *